US006251032B1

(12) United States Patent
Butler

(10) Patent No.: US 6,251,032 B1
(45) Date of Patent: Jun. 26, 2001

(54) SELF-ILLUMINATED HOP SCOTCH GAME

(76) Inventor: Marilyn L. Butler, 6829 S. Street, St. Lawrence, IL (US) 60637

( * ) Notice: Subject to any disclaimer, the term of this patent is extended or adjusted under 35 U.S.C. 154(b) by 0 days.

(21) Appl. No.: 09/469,894

(22) Filed: Dec. 22, 1999

Related U.S. Application Data

(60) Provisional application No. 60/113,376, filed on Dec. 23, 1998.

(51) Int. Cl.[7] ..... A63B 67/00
(52) U.S. Cl. ..... 473/414; 273/DIG. 24
(58) Field of Search ..... 473/414, 415, 473/499–501, 571, 594; 273/DIG. 24; 446/397

(56) References Cited

U.S. PATENT DOCUMENTS

D. 172,987 * 9/1954 Quigley ..... 473/414
3,971,560 * 7/1976 Panosh ..... 273/DIG. 24
4,848,743 * 7/1989 Rozek ..... 473/414
5,785,613 * 7/1998 Francis ..... 473/414
5,839,976 * 11/1998 Darr ..... 473/414
5,895,308 * 4/1999 Spector ..... 446/397

* cited by examiner

*Primary Examiner*—Mark S. Graham
*Assistant Examiner*—Mitra Aryanpour
(74) *Attorney, Agent, or Firm*—Goldstein Law Offices P.C.

(57) ABSTRACT

A self-illuminated hop scotch game including a hop scotch playing field defined by a plurality of spaces arranged in a predetermined order. Each of the spaces have an outer periphery with a border disposed thereon. The border is coated with a fluorescent material. A plurality of playing pieces are provided with each having a generally circular configuration. Each of the playing pieces are comprised of a soft exterior surface with an interior filled with beans.

2 Claims, 2 Drawing Sheets

SELF-ILLUMINATED HOP SCOTCH GAME

CROSS REFERENCES AND RELATED SUBJECT MATTER

This application relates to subject matter contained in provisional patent application Ser. No. 60/113,376, filed in the United States Patent & Trademark Office on Dec. 23, 1998.

BACKGROUND OF THE INVENTION

The present invention relates to a self-illuminated hop scotch game and more particularly pertains to providing an improvement in playing the game of hop scotch.

It is customary in the playing of hop scotch for the participants to mark on a ground surface, such as a street or sidewalk, the playing field. This is usually accomplished using chalk or crayons. The field generally consists of a plurality of defined areas arranged in different designs according to the desires of the participants. The participants then hop from one area to the other in accordance with rules of the game. Generally, when playing outdoors, the playing field will not last long enough to play on different days, due to inclement weather erasing the playing field. Additionally, the game is generally limited to play in the daytime so that the playing field can be properly visualized. Furthermore, the participants use found objects, such as rocks or bottle caps, as their markers for playing the game.

The present invention attempts to provide a permanent playing field that can be seen at nighttime in addition to daytime, and also provide markers that are constructed of a soft material that can also have additional functions to liven up the game.

The use of hop scotch games is known in the prior art. More specifically, hop scotch games heretofore devised and utilized for the purpose of playing the game of hop scotch are known to consist basically of familiar, expected and obvious structural configurations, notwithstanding the myriad of designs encompassed by the crowded prior art which have been developed for the fulfillment of countless objectives and requirements.

By way of example, U.S. Pat. No. 25,474 to O'Rear discloses a portable foldable construction for a hop scotch game. U.S. Pat. No. 2,017,536 to Hase discloses a portable hop scotch game that can be rolled or folded. U.S. Pat. No. 3,115,340 to Stasiuk discloses a series of rings used for a children's hopping game for use outdoors or indoors. U.S. Pat. No. 2,891,793 to Mudry discloses a game field divider for playing inside.

While these devices fulfill their respective, particular objective and requirements, the aforementioned patents do not describe a self-illuminated hop scotch game for providing an improvement in playing the game of hop scotch.

In this respect, the self-illuminated hop scotch game according to the present invention substantially departs from the conventional concepts and designs of the prior art, and in doing so provides an apparatus primarily developed for the purpose of providing an improvement in playing the game of hop scotch.

Therefore, it can be appreciated that there exists a continuing need for new and improved self-illuminated hop scotch game which can be used for providing an improvement in playing the game of hop scotch. In this regard, the present invention substantially fulfills this need.

SUMMARY OF THE INVENTION

In the view of the foregoing disadvantages inherent in the known types of hop scotch games now present in the prior art, the present invention provides an improved self-illuminated hop scotch game. As such, the general purpose of the present invention, which will be described subsequently in greater detail, is to provide a new and improved self-illuminated hop scotch game and method which has all the advantages of the prior art and none of the disadvantages.

To attain this, the present invention essentially comprises a hop scotch playing field defined by a plurality of spaces arranged in a predetermined order. Each of the spaces have a number thereon in an ascending order from a front of the playing field to a back thereof. The playing field further includes a rest area secured to the back thereof. The rest area has a decorative illustration disposed thereon. Each of the spaces have an outer periphery with a border disposed thereon. The border is coated with a fluorescent material. A plurality of playing pieces are provided with each having a generally circular configuration. Each of the playing pieces are comprised of a soft exterior surface with and interior filled with beans. Each of the playing pieces have a music playing device disposed within the interior thereof. The music playing device has a power switch extending outwardly of the soft exterior surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-illuminated hop scotch game which has all the advantages of the prior art hop scotch games and none of the disadvantages.

It is another object of the present invention to provide a new and improved self-illuminated hop scotch game which may be easily and efficiently manufactured and marketed.

It is a further object of the present invention to provide a new and improved self-illuminated hop scotch game which is of durable and reliable construction.

An even further object of the present invention is to provide a new and improved self-illuminated hop scotch game which is susceptible of a low cost of manufacture with regard to both materials and labor, and which accordingly is then susceptible of low prices of sale to the consuming public, thereby making such a self-illuminated hop scotch game economically available to the buying public.

Even still another object of the present invention is to provide a new and improved self-illuminated hop scotch game for providing an improvement in playing the game of hop scotch.

Lastly, it is an object of the present invention to provide a new and improved self-illuminated hop scotch game including a hop scotch playing field defined by a plurality of spaces arranged in a predetermined order. Each of the spaces have an outer periphery with a border disposed thereon. The border is coated with a fluorescent material. A plurality of playing pieces are provided with each having a generally circular configuration. Each of the playing pieces are comprised of a soft exterior surface with and interior filled with beans.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
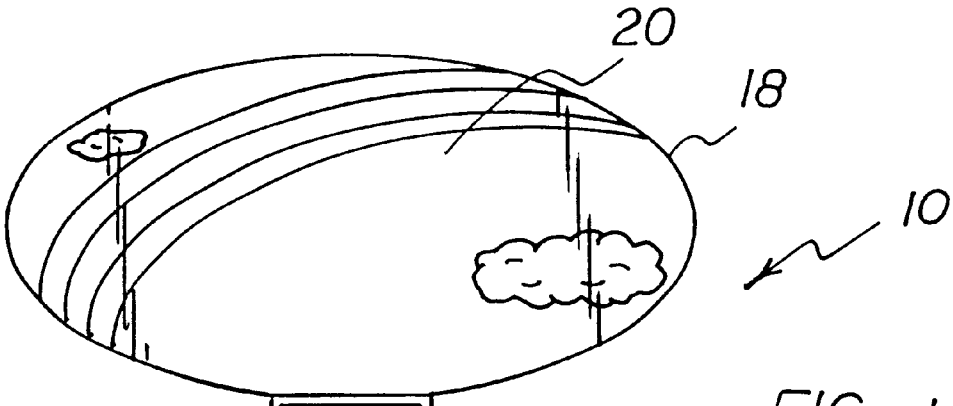
FIG. 1 is a plan view of the preferred embodiment of the self-illuminated hop scotch game constructed in accordance with the principles of the present invention.
Figure 2:
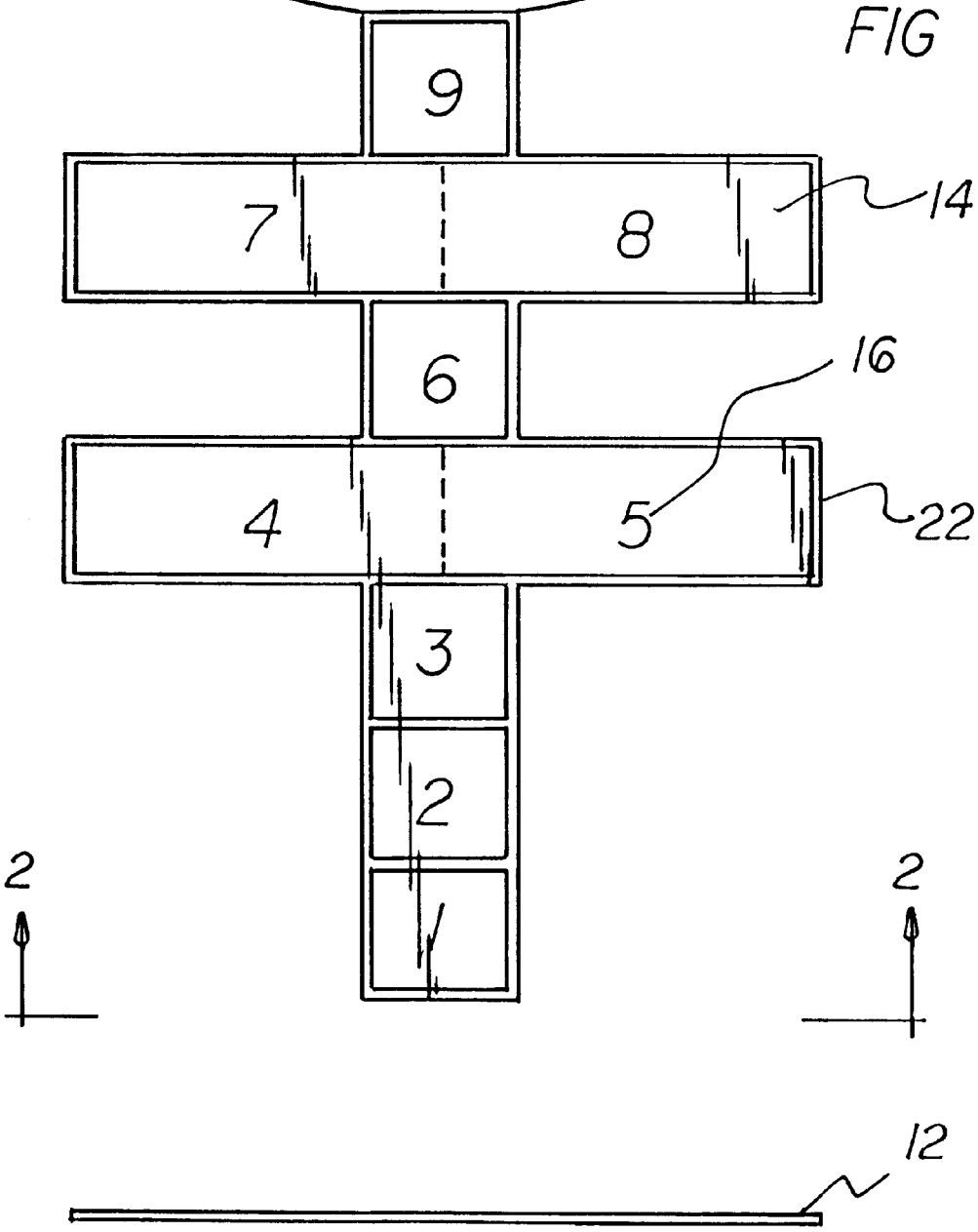
FIG. 2 is a front view of the present invention as taken along line 2—2 of FIG. 1.
Figure 3:
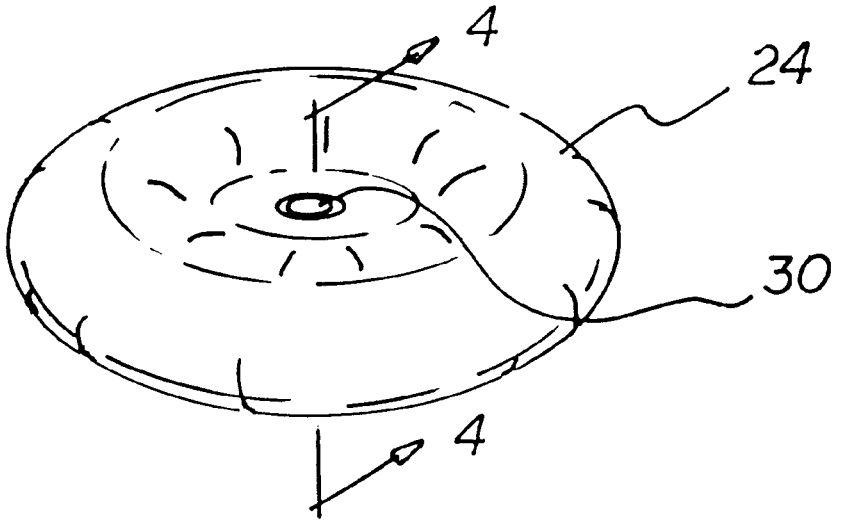
FIG. 3 is a perspective view of the musical playing piece of the present invention.
Figure 4:
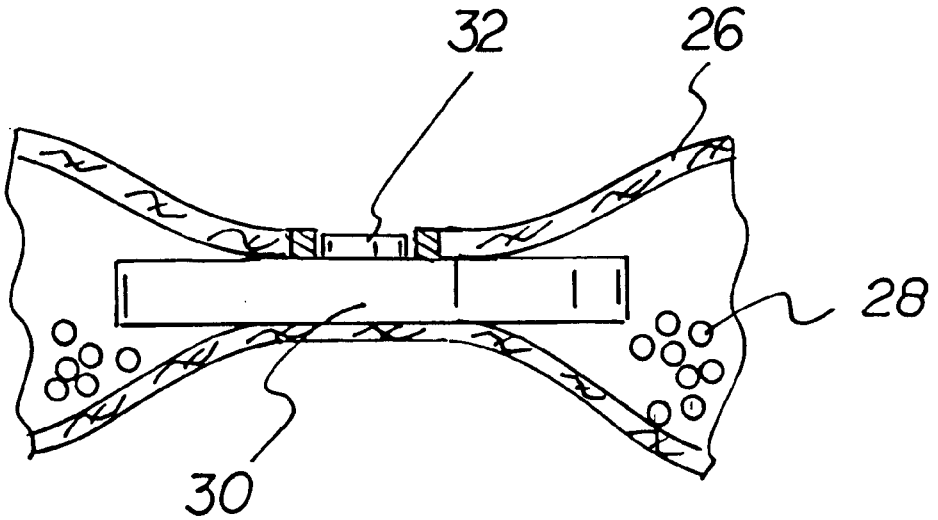
FIG. 4 is a cross-sectional view of the present invention as taken along line 4—4 of FIG. 3.

With reference now to the drawings, and in particular, to FIGS. 1 through 4 thereof, the preferred embodiment of the new and improved self-illuminated hop scotch game embodying the principles and concepts of the present invention and generally designated by the reference number 10 will be described.

Specifically, it will be noted in the various Figures that the device relates to a self-illuminated hop scotch game for providing an improvement in playing the game of hop scotch. In its broadest context, the device consists of a hop scotch playing field and a plurality of playing pieces. Such components are individually configured and correlated with respect to each other so as to attain the desired objective.

The hop scotch playing field 12 is defined by a plurality of spaces 14 arranged in a predetermined order. Each of the spaces 14 have a number 16 thereon in an ascending order from a front of the playing field to a back thereof. The playing field 12 further includes a rest area 18 secured to the back thereof. The rest area 18 has a decorative illustration 20 disposed thereon. Each of the spaces 14 have an outer periphery with a border 22 disposed thereon. The border 22 is coated with a fluorescent material. The fluorescent material allows the playing field to be seen at nighttime. The playing field 12 would also be provided with fold lines to allow for the easy folding thereof when not in use.

The plurality of playing pieces 24 each have a generally circular configuration. Each of the playing pieces 24 are comprised of a soft exterior surface 26 with and interior filled with beans 28. Each of the playing pieces 24 have a music playing device 30 disposed within the interior thereof. The music playing device 30 has a power switch 32 extending outwardly of the soft exterior surface 26. The music playing device 30 can be activated, via the power switch 32, to play continuously until deactivated by pressing the power switch 32.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A self-illuminated hop scotch game for providing an improvement in playing the game of hop scotch comprising, in combination:

a hop scotch playing field defined by a plurality of spaces arranged in a predetermined order, each of the spaces having a number thereon in an ascending order from a front of the playing field to a back thereof, the playing field further including a rest area secured to the back thereof, the rest area having a decorative illustration disposed thereon, each of the spaces having an outer periphery with a border disposed thereon, the border being coated with a fluorescent material;

a plurality of playing pieces each having a generally circular configuration, each of the playing pieces being comprised of a soft exterior surface with an interior filled with beans, each of the playing pieces having a music playing device disposed within the interior thereof, the music playing device having a power switch extending outwardly of the soft exterior surface.

2. A self-illuminated hop scotch game for providing an improvement in playing the game of hop scotch comprising, in combination:

a hop scotch playing field defined by a plurality of spaces arranged in a predetermined order, each of the spaces having an outer periphery with a border disposed thereon, the border being coated with a fluorescent material;

a plurality of playing pieces each having a generally circular configuration, each of the playing pieces being comprised of a soft exterior surface with an interior filled with beans and a music playing device, wherein the music playing device has a power switch extending outwardly of the soft exterior surface.

* * * * *